US005426881A

United States Patent [19]

Ruger

[11] Patent Number: 5,426,881

[45] Date of Patent: Jun. 27, 1995

[54] LEVER ARRANGEMENT FOR AUTOMATIC PISTOL FOR POSITIONING FIRING PIN AND FOR DECOCKING

[75] Inventor: William B. Ruger, Croydon, N.H.

[73] Assignee: Sturm, Ruger & Company, Inc., Southport, Conn.

[21] Appl. No.: 135,886

[22] Filed: Oct. 13, 1993

Related U.S. Application Data

[63] Continuation of Ser. No. 957,208, Oct. 6, 1992, abandoned, which is a continuation of Ser. No. 744,616, Aug. 12, 1991, abandoned.

[51] Int. Cl.[6] ..... F41A 17/24

[52] U.S. Cl. ..... 42/70.08; 89/148

[58] Field of Search ..... 42/70.08; 89/148, 154

[56] References Cited

U.S. PATENT DOCUMENTS

| | | | |
|---|---|---|---|
| 2,110,317 | 3/1938 | Altenburger | 89/148 |
| 2,373,213 | 4/1945 | Williams . | |
| 4,282,795 | 8/1981 | Beretta | 42/70.08 |
| 4,536,981 | 8/1985 | Giragosian | 42/7 |
| 4,589,327 | 5/1986 | Smith | 89/148 |
| 4,590,697 | 5/1986 | Ruger et al. | 42/70.08 |
| 5,245,776 | 9/1993 | Dornaus | 42/70.08 |

FOREIGN PATENT DOCUMENTS

| | | | |
|---|---|---|---|
| 389759 | 1/1990 | Austria . | |
| 634617 | 2/1928 | France . | |
| 3120024 | 12/1982 | Germany | 42/70.08 |
| 198439 | 6/1938 | Switzerland | 42/70.08 |
| 460859 | 2/1937 | United Kingdom . | |

*Primary Examiner*—Stephen M. Johnson
*Attorney, Agent, or Firm*—Pennie & Edmonds

[57] ABSTRACT

A device or arrangement for automatic firearms in which a transverse rotatable element is mounted in the slide is operable to move by camming action the firing pin partially forward to avoid being struck by the hammer, all prior to its further functioning to rotate the sear to release the hammer. The device also prevents further movement forward of the firing pin during rotation and the device may include means to hold it in its firing-pin-forward position.

12 Claims, 6 Drawing Sheets

LEVER ARRANGEMENT FOR AUTOMATIC PISTOL FOR POSITIONING FIRING PIN AND FOR DECOCKING

RELATED APPLICATIONS

This application is a continuation of application Ser. No. 07/957,208 filed Oct. 6, 1992 now abandoned, which in turn is a continuation of application Ser. No. 07/744,616 filed Aug. 12, 1991 now abandoned.

BACKGROUND OF THE INVENTION

Prior automatic firearms have included arrangements for moving the firing pin forward in an effort to prevent the hammer engaging the pin as it descends (U.S. Pat. No. 4,589,327). It has also been proposed to rotate levers to move a protrusion to a position to protect the firing pin from engaging the hammer as the hammer moves toward its down position (U.S. Pat. No. 4,590,697).

However, none of these arrangements has provided or suggested a compact decocking lever arrangement which is capable, as initially rotated, of moving the firing pin forward a limited distance, preventing further movement forward and upon further rotation of the lever, causing the sear to release the hammer.

SUMMARY OF THE INVENTION

Broadly, the present invention is a device or arrangement rotatable transversely through the slide including a hand rotatable lever which, as initially rotated, causes an internal first cam surface to urge the firing pin forward and also has a second cam surface which upon further rotation engages the sear to rotate. Sear rotation releases the hammer from its cocked position allowing the hammer to fall into contact with the stop surface at the bottom of the hammer slot in the slide.

It is also a feature of the arrangement that it may be spring urged to return to its rest position upon release by the operator.

It is also a feature that the device not only moves the firing pin forward but also prevents any additional firing pin movement forward by action of the hammer as the hammer is lowered.

DESCRIPTION OF THE PREFERRED EMBODIMENT

Figure 1A:
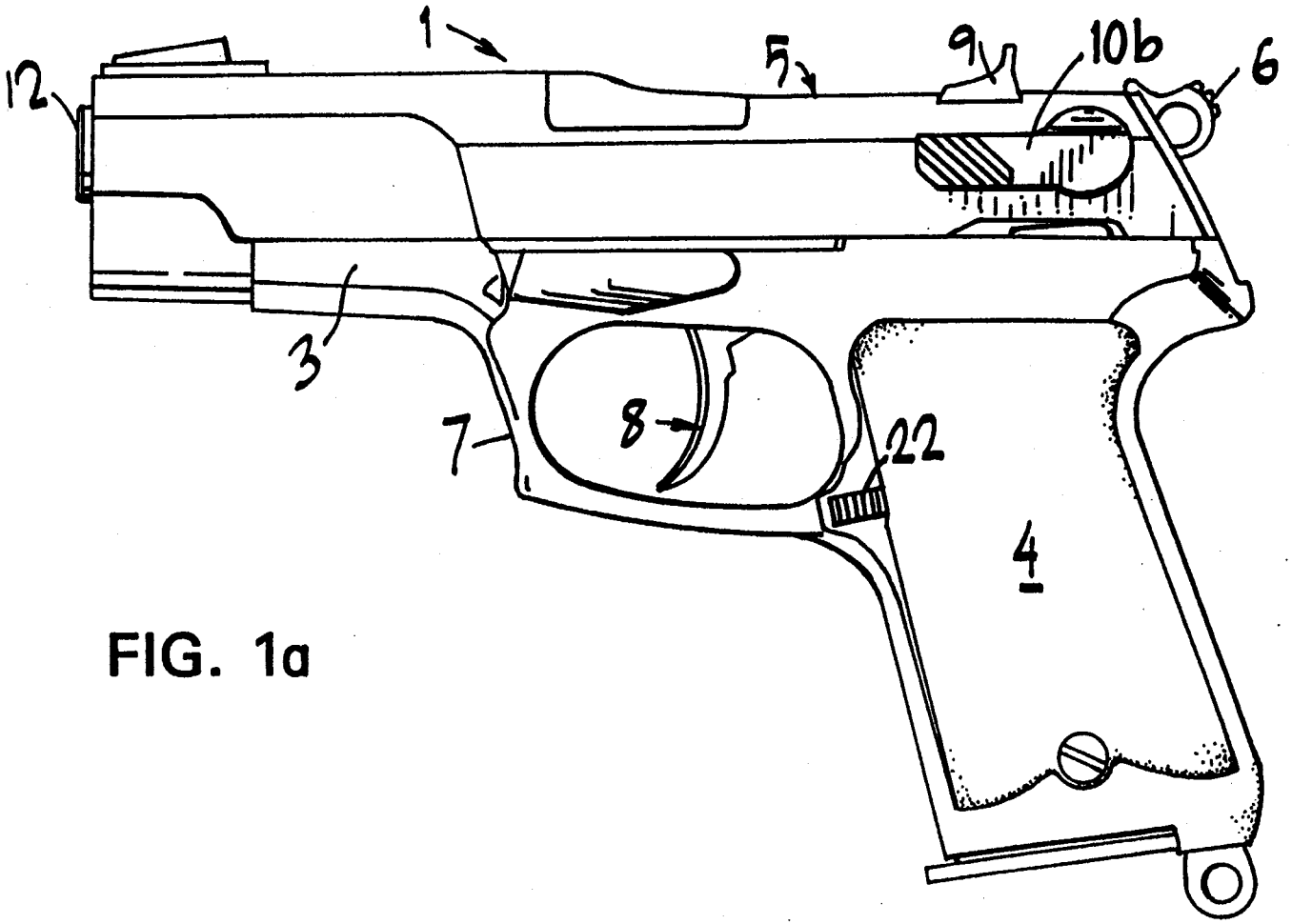
FIG. 1*a* is a side elevational view of the left side of the pistol including the left portion of the device.
Figure 1B:
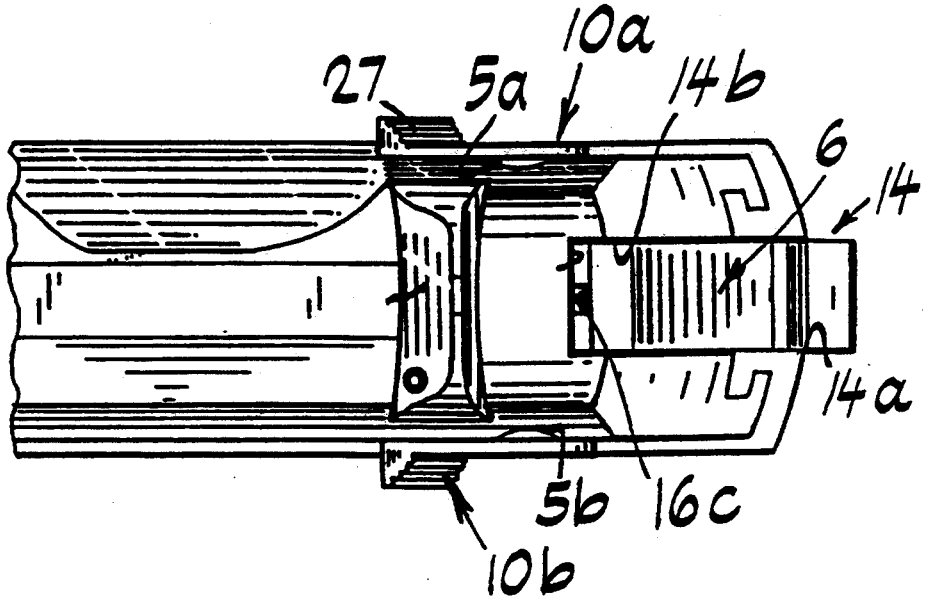
FIG. 1*b* is an enlarged partial plan view of the rear portion of the pistol.
Figure 1C:
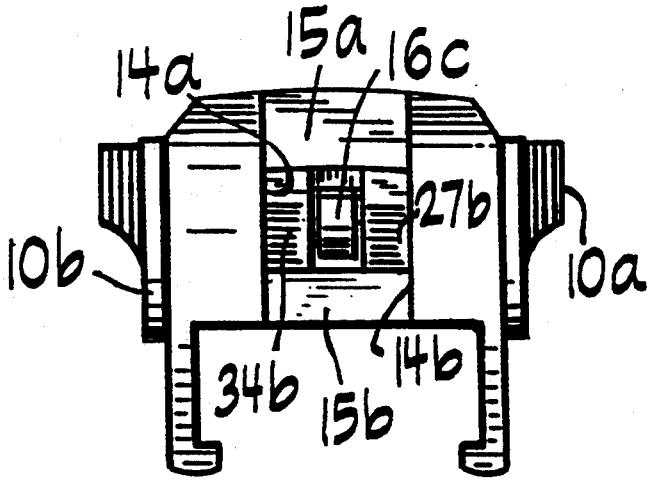
FIG. 1*c* is a rear end view of the slide with the device in its nonoperating position.

In FIGS. 1*a*–1*c*, pistol 1 includes barrel 2, frame 3, grip 4, slide 5, hammer 6, trigger guard 7, trigger 8 and rear sight 9. Also shown is device 10 positioned in round slide side holes 5*a*, 5*b*. FIG. 1*b* shows rear slide cutout slot 14 having surfaces 14*a*, 14*b* parallel to barrel 2 and hammer lower seating surface 15*b*. Also shown is surface 15*a*. Lower surface 15*b* is rearward of upper surface 15*a* a few thousandths of an inch though this small dimensional difference is not shown in FIG. 1*b*. Protruding rear firing pin portion 16*c* of firing pin 16 is shown about to be struck by hammer 6 during its downward movement after being release from sear 17 (see FIG. 1*b* and 3*a*, 3*b*). Also shown is right side portion 10*a* and left side portion 10*b* of device 10. FIG. 1*c* further shows decocking portion surface 34*b* of portion 10*b* and surface 27*b* of portion 10*a*.

Figure 2:
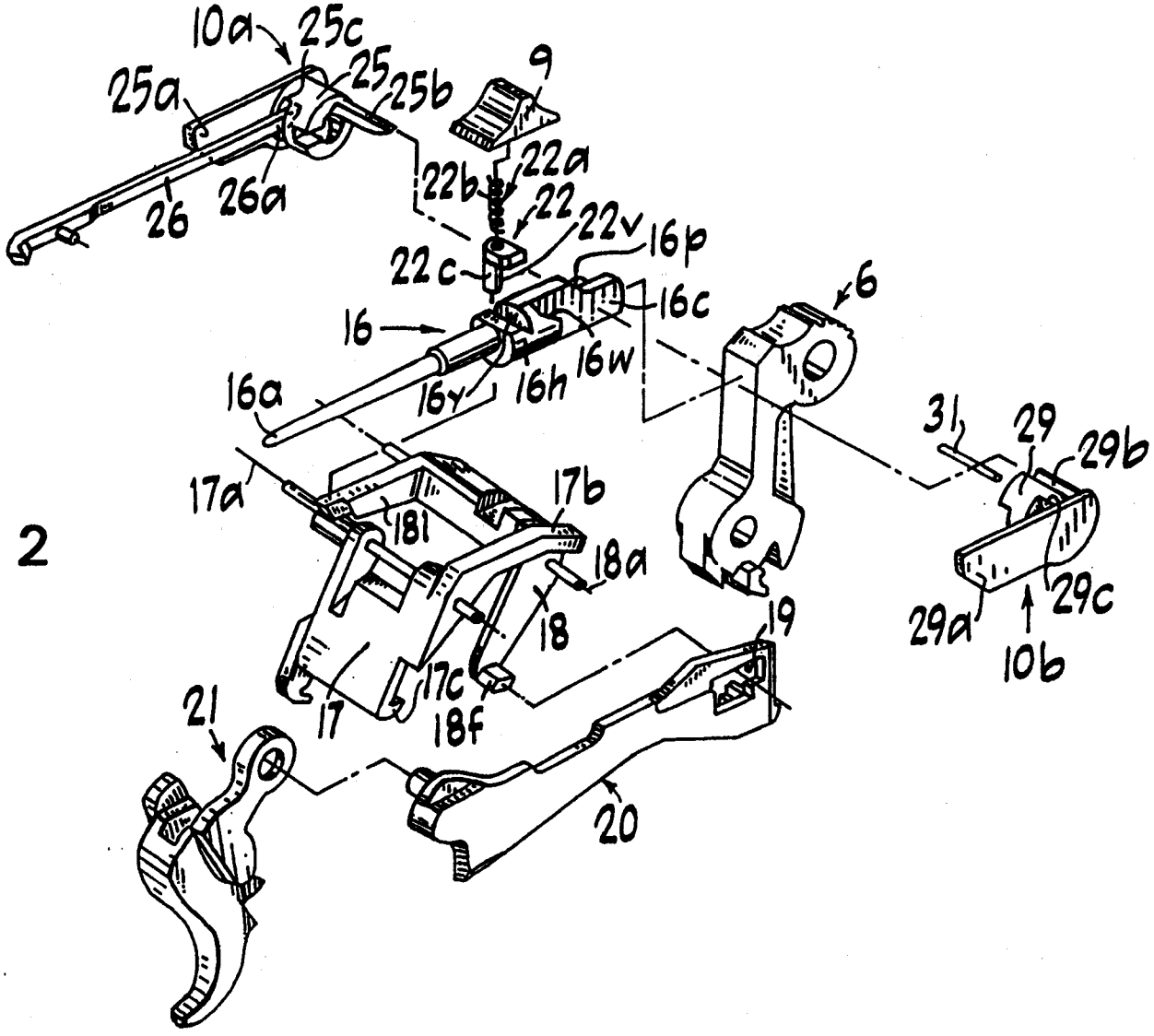
FIG. 2 is an exploded perspective view of the two interconnectable device portions and certain associated parts.

Turning to FIG. 2, there is shown right side portion 10*a*, left side portion 10*b*, firing pin 16 with front end 16*a*, central head 16*h*, vertical head surface 16*v*, curved head and cam surface 16*w*, rear portion 16*c* and right side projection 16*p*. Sear 17, pivotal about axis 17*a*, has upper arm 17*c* which is acted on by decocker portion 10*b* as later described. Upper block piece 22 engages vertical surface 16*v* of firing pin 16 to prevent forward movement of the pin 6 against the cartridge (not shown). Lower blocker unit 18 pivotal about axis 18*a* has lever arm 181 for raising upper firing pin block piece 22 to permit firing pin vertical surface 16*v* to move forward under raised block piece 22.

Upper block crosspiece 22 which includes vertical stem piece 22*v* and plunger portion 22*c* is urged downwardly by a plunger assembly 22*a* comprised of spring 22*b* and plunger 22*c* which is contained by rear sight 9. Blocker piece 22 is sufficiently forward of vertical surface 16*v* even when in its lower position to permit pin 16 to be moved forward by device 10 as further described. Lower blocker unit 18 carries a side foot piece 18*f* for positioning in opening 19 of trigger bar 20. When trigger 20 moves rearward during the last portion of trigger pull, blocker unit 18 is rotated causing lever arm 181 to lift firing pin block crosspiece 22 to a point where crosspiece 22 is clear of vertical surface 16*v* of firing pin 16 just prior to firing. Right side portion 10*a* includes body 25, wing thumb piece 25*a*, portion engageable prong 25*b* and lock groove 25*c*. Elongated lock piece 26 is also shown which, as assembled, is positioned in and secured to slide 5 with end 26*a* in slot 25*c* to hold portion 10*a* in slide side hole 5*a* while permitting partial rotation of portion 10*a* therein. Also shown is a hammer 6, rear notch 17*c* and trigger 21.

Figure 5:
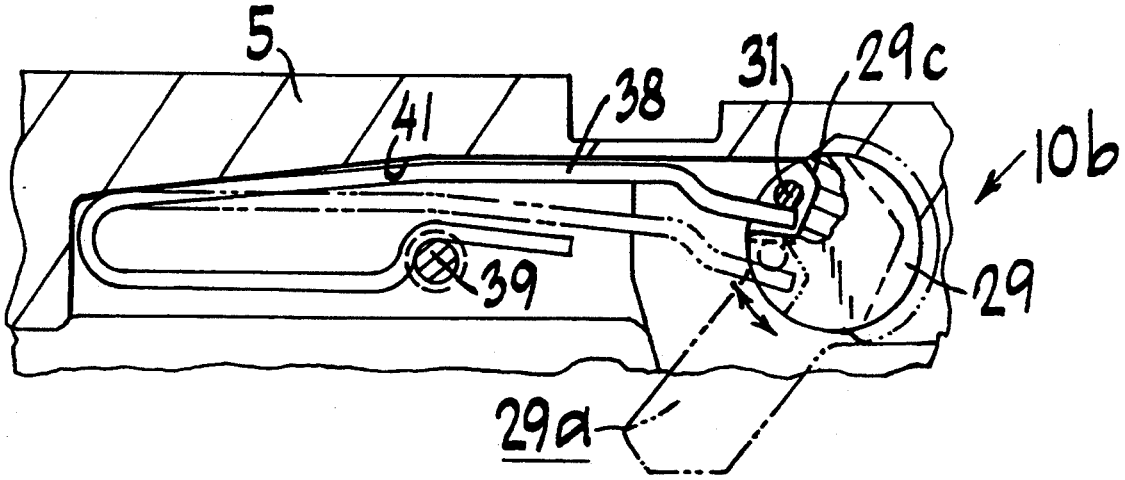
FIG. 5 is a side elevational view showing a spring being loaded as the device is held in the active turned-down position.

Further with respect to FIG. 2, left side portion 10*b* includes left body 29, thumb piece or wing 29*a*, protrusion-receiving slot 29*b*, spring-receiving recess 29*c* with cross rod 31 mounted therein (see also FIG. 5). As assembled, portion 10*a* and portion 10*b* rotate as a unit providing ease of assembly and ambidextrous operation.

Figure 3A:
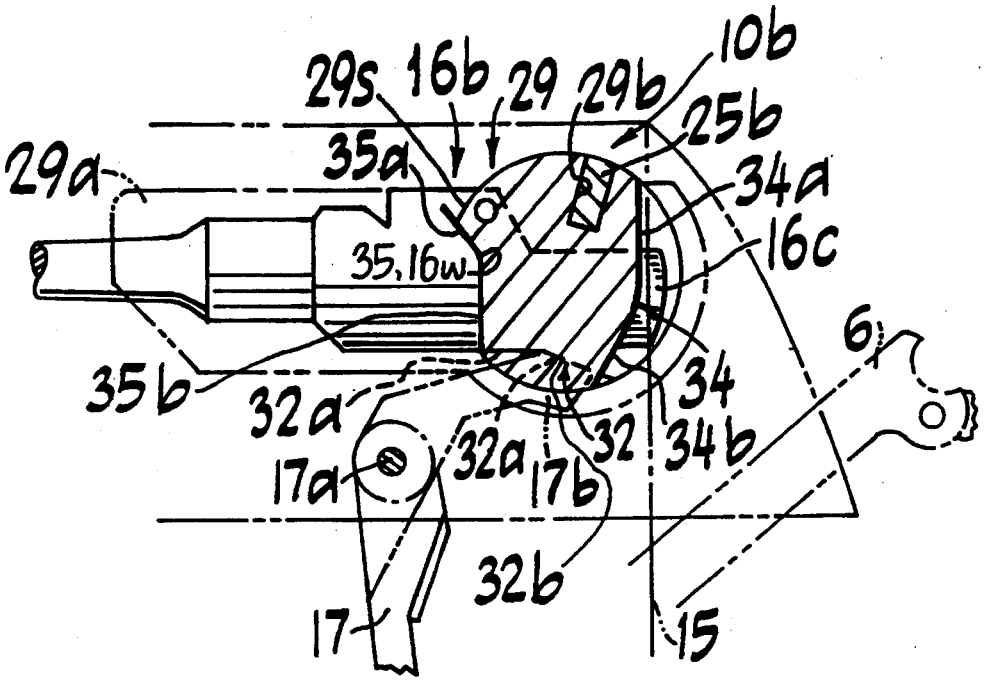
FIG. 3*a* is a partial elevational view of the right lever portion, sear, and slide.

Turning now to FIG. 3*a*, left portion 10*b* with its body 29, and its wing 29*a* slot 29*b* has rear surface 34 comprised of surface portions 34*a*, 34*b*. Also shown is lower sear cam surface 32 comprising surface portion 32*a*, 32*b*. Sear arm 18*b* nests against surface 32. Third cam surface 35 comprising surface portions 35*c*, 35*b*, nests against firing pin surface 16*w*. Hammer engaging firing pin portion 16*c*, when in its ready-to-fire position extends into slide cutout 14 beyond and to the rear of vertical hammer seating surfaces 15. Firing pin 16 is urged to the rear against a stop by firing pin spring (neither of which are shown) so that hammer engaging portion 16*c* is properly exposed to hammer 6 during its downward and forward movement as pistol 10 is fired.

Figure 3B:
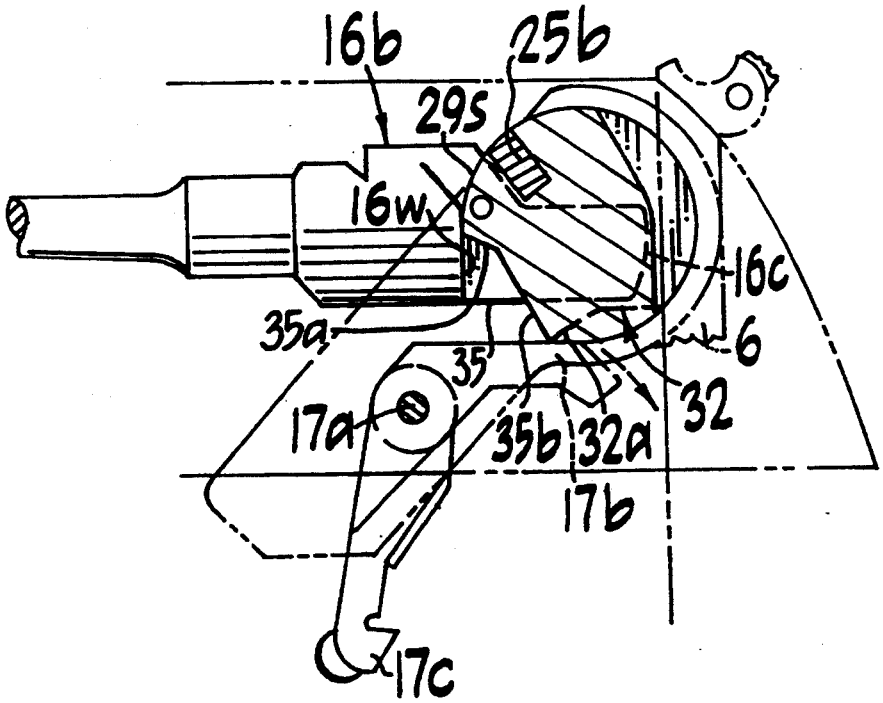
FIG. 3*b* is a view similar to FIG. 3*a* with the right portion in the full activated position.

In FIG. 3*b*, hammer 6 is released as lower cam surface 32 rotates out of its nested position thus moving sear arm 17*b* downwardly. Also, as portion 10*b* rotates its cam surface 35*a* and surface 29*s* of body 29 act on firing pin surface 16*w* to move firing pin 16 forward. Firing pin rear portion 16*c* is thereby moved to the left of lower surface 15*b* thus protecting pin 16 from being struck and propelled forward by hammer 6.

Figure 4:
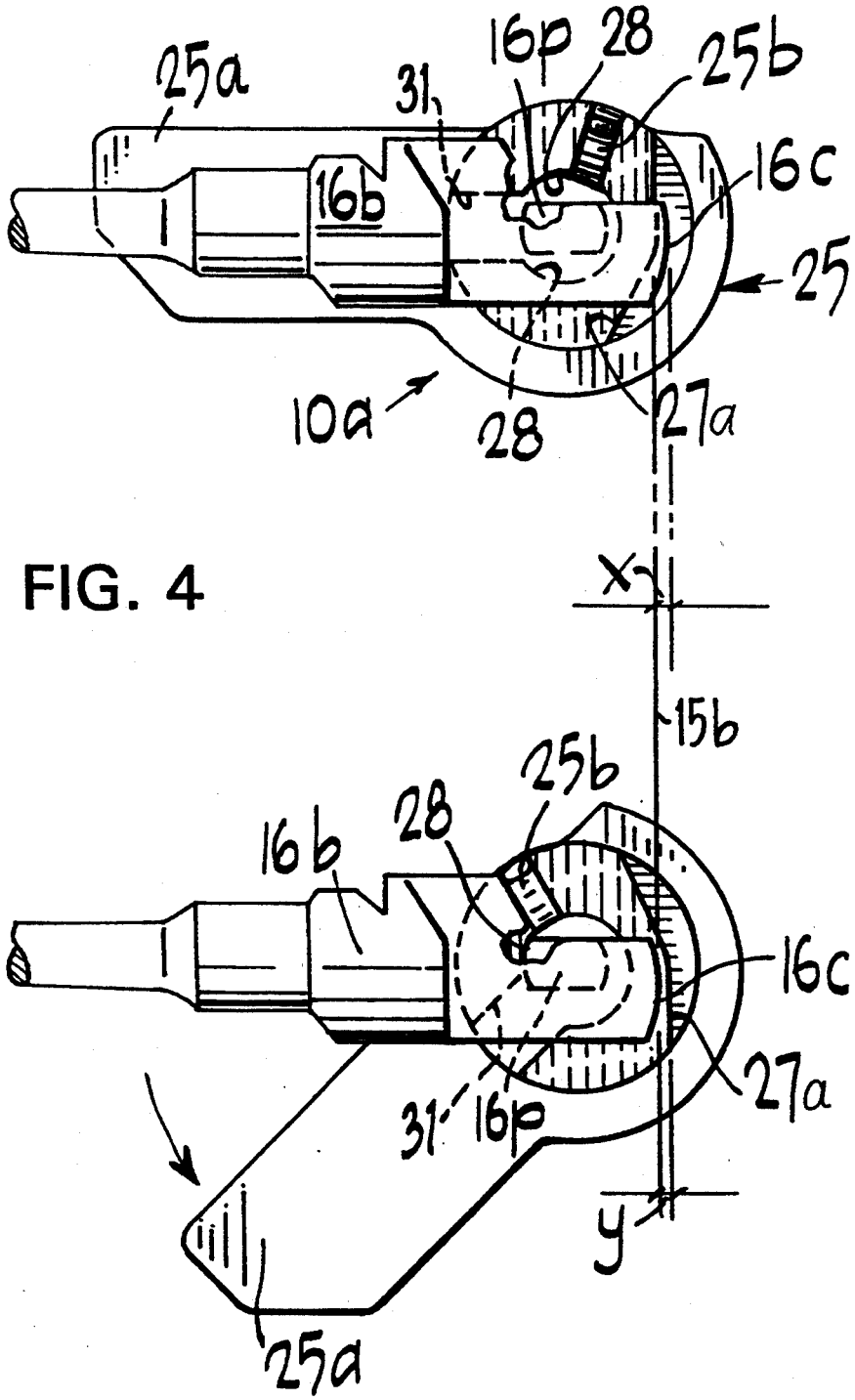
FIG. 4 is a partial elevational view of left lever portion and firing pin with the device shown both in its inactive and its active positions.

Turning to FIG. 4, body 25 of right portion 10*a* includes internal curved pocket 28 and opening 30 in the side pocket 28. Pocket 28 engages firing pin right projection 16*p* as portion 10*a* is rotated counterclockwise to prevent projection 16*p* (and pin 16) from moving further in the forward direction. Opening 31 functions to permit pin side projection 16*p* to move forward during firing. Note portion 16*c* is x distance to the rear of lower surface 15*b* before decocker rotation and is y distance forward of lower surface 15*b* after rotation of the decocker 10 and the camming forward by portion 10*b* as described above.

Finally, in FIG. 5, spring retaining recess 41 in slide 5 accommodates return spring 38 which rests under pin 31 in slot 29*c* of body 29 of portion 10*b*. Pin 39 holds spring 38 in position. The phantom lines show decocker portion 10*b* rotated to depress spring 38.

In operation, device 10 is rotated from its at rest position through its arcuate range of about 45° including intermediate activating positions until it reaches its fully activated position (FIGS. 3*b* and 4) and is then released for return by spring 38 (FIG. 5) or, alternatively, held in its active position. During movement with spring return the following occurs:

(1) firing pin 16 through its surface 16*w* is cammed forward until the rearward end 16*c* of pin 16 is moved forward of slide surface 15*b*;

(2) when (1) above has been accomplished, sear 17 is thereafter rotated by cam surface 32 acting on sear arm 17*b* to rotate sear 17 and to release hammer 6 which is urged downwardly against surface 15*b* permitting decocking without discharge of pistol 10; and (3) throughout rotation of device 10 surfaces 34*a*, 34*b* and 27*a*, 27*b* remain forward of seating surface 15*b*;

(4) as hammer 6 is released, cam surface 28 prevents firing pin 16's forward movement by engaging and blocking further forward movement of pin projection 16*p*;

(5) the device 10, as released by the operator, returns to its rest position leaving hammer 6 against surface 15*b*, surfaces 29 and 35 rotate allowing the firing pin 16 to move rearward and slot 31 is oriented to permit firing pin 16 to thereafter move forward against the cartridge when the hammer strikes pin 16 during subsequent normal firing sequences.

During operation without spring return, device 10 is held in its active firing-pin-forward position until the operator rotates device 10 back to permit the firearm to be operated in the firing mode.

I claim:

1. In a firearm comprising a slide, a barrel, a cartridge in said barrel, a hammer and a rearward hammer seating surface which limits downward movement of the hammer when the firearm is fired, a reciprocal firing pin lying along a horizontal axis having a forward end for engaging the cartridge and a rearward end normally extending rearward of the seating surface and the firing pin having two sides and a rotatable sear engageable with the hammer to hold the hammer in a cocked position, the improvement comprising 1) an upper sear arm on said rotatable sear and hammer engaging means on said sear;

2) a rotatable device including pocket means transverse with respect to a longitudinal axis of the firearm rotatably movable through an arc from an inactive position to a fully active position, said device during initial rotation causing forward movement of the firing pin;

3) sear engagement cam means on the rotatable device for engaging said upper arm of said sear to rotate said sear as said device is rotated to move the hammer engaging means to release the hammer;

4) said forward movement of the firing pin causing engagement of a firing pin projection cam portion extending from one side of said two sides with said pocket means on the rotatable device; and 5) firing pin engagement cam means on the rotatable device for moving the pin forward a selected distance until said pin is positioned forward of the hammer seating surface and said firing pin projection cam portion engages said pocket means whereby upon complete rotatable movement of said device the hammer seating means is positioned rearward of the firing pin and the firing pin engages with the pocket means to prevent the hammer from striking the firing pin upon its release from the sear.

2. The firearm transverse rotatable device of claim 1 in which the device includes a rotatable body in turn comprising two interconnecting body portions mounted transversely in the slide and in which said sear engagement cam means and said pin engagement means are part of one such body.

3. The firearm transverse rotatable device of claim 2 having in addition a surface on the other body portion that limits said forward movement of the firing pin during decocking.

4. The firearm transverse rotatable device of claim 1 in which said device remains in said fully active position to hold the firing pin forward.

5. The firearm of claim 1 in which the transverse rotatable device is moved through said arc and thereafter held.

6. In an automatic firearm comprising a hammer, a rotatable sear, a slide and a rear hammer down seating surface on the slide, a transverse rotatable device having a rest position and a number of activating functions comprising a) first and second body portions shaped to interconnect with one another, with each said portion being substantially cylindrical in shape, said portions in turn having i) surface means on each said portion positioned spaced from and forward of said seating surface;

ii) one of said surface means being a lower sear camming surface on the first portion to cam the rotatable sear;

iii) a second of said surface means being a firing pin camming surface on the first portion to cam the firing pin forward; and iv) a third of said surface means being a limit surface on the second portion to limit movement of the firing pin forward of a selected point during decocking.

7. The device of claim 6 in which the first body portion has a hand operable lever means extending from one of its side.

8. The firearm of claim 7 in which the first portion has an internal spring means receiving recess and spring means positioned in the spring-receiving recess for causing the lever means to return to its inactive position.

9. The firearm of claim 7 in which the firearm in addition has holding means which holds the lever means in a position which causes the firing pin to be positioned forward of said hammer down seating surface.

10. In a firearm comprising a hammer, a barrel, a cartridge in said barrel, a slide with a rearward hammer seating surface which limits downward movement of the hammer when the firearm is fired, a firing pin having a forward end for engaging the cartridge and a rearward end normally extending rearward of the seating surface and a sear engageable with the hammer to hold the hammer in a cocked position, the improvement comprising 1) a device transverse with respect to a longitudinal axis of the firearm rotatable about a fixed axis movable through an arc from an inactive position to an active position;
2) sear engagement cam means on the rotatable device for engaging the sear to rotate the sear during such rotation of said device through said arc to release the hammer at a selected position;
3) firing pin engagement cam means on the rotatable device for causing movement of the pin forward during rotation through such arc of the device so that the pin is positioned forward of the slide seating surface a selected distance to prevent the hammer from striking the firing pin upon release of said hammer from the sear; and
4) limit means in the transverse rotatable device that limits forward movement of the firing pin as the device is rotated in its arc.

11. In a firearm comprising a slide, a barrel, a cartridge in the barrel, a hammer and a rearward hammer seating surface which limits downward movement of the hammer when the firearm is fired, a firing pin having a forward end for engaging the cartridge and a rearward end normally extending rearward of the seating surface and a sear engageable with the hammer to hold the hammer in a cocked position, the improvement comprising a) an upper sear arm on said sear and hammer engaging means on said sear;
b) a rotatable device transverse with respect to a longitudinal axis of the firearm movable through an arc, said device including a rotatable body comprising two interconnecting body portions mounted transversely in the slide with one said body portion including
(1) a sear engagement cam means for engaging said upper arm of said sear to rotate the sear to move the hammer engaging means to release the hammer when said rotatable device is moved through said arc; and
(2) a pin engagement means for moving the pin forward of the hammer seating surface;
c) said device further having in the other said body portion surface means to limit forward movement of the firing pin during decocking;

whereby upon rotation of said device the firing pin is moved forward of the seating surface to prevent the hammer from striking the firing pin upon its release from the sear.

12. In a firearm comprising a slide, a barrel, a cartridge in said barrel, a hammer and a rearward hammer seating surface which limits downward movement of the hammer when the firearm is fired, a reciprocal firing pin lying along a horizontal axis having a forward end for engaging the cartridge and a rearward end normally extending rearward of the seating surface and the firing pin having two sides and a rotatable sear engageable with the hammer to hold the hammer in a cocked position, the improvement comprising 1) an upper sear arm on said rotatable sear and hammer engaging means on said sear;
2) a rotatable device transverse with respect to a longitudinal axis of the firearm movable through an arc, said rotatable device including a rotatable body in turn comprising two interconnecting body portions, a sear engagement cam means and a firing pin engagement means on one said body portion and in which a limit surface is in the other said body portion which surface limits forward movement of the firing pin during decocking;
3) such sear engagement cam means on the rotatable device for engaging said upper arm of said sear to rotate said sear to move the hammer engaging means to release the hammer;
4) a firing pin cam portion extending from one side of said two sides; and
5) such firing pin engagement means engageable with said firing pin cam portion for moving the pin forward so that said pin is positioned forward of the hammer seating surface a selected distance whereby upon rotation of said device in its arc the seating surface is positioned rearward of the firing pin to prevent the hammer from striking the firing pin upon its release from the sear.

* * * * *